US007138928B2

(12) United States Patent
Dischert

(10) Patent No.: US 7,138,928 B2
(45) Date of Patent: Nov. 21, 2006

(54) METHOD AND APPARATUS FOR POSITIVE CONTROL OF DEVICES WITH TOGGLE POWER CONTROL

(75) Inventor: Lee R. Dischert, Burlington, NJ (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 375 days.

(21) Appl. No.: 10/373,366

(22) Filed: Feb. 24, 2003

(65) Prior Publication Data

US 2004/0164875 A1 Aug. 26, 2004

(51) Int. Cl.
*G08C 19/00* (2006.01)

(52) U.S. Cl. ..... 340/825.72; 713/1; 51/103

(58) Field of Classification Search ..... 340/825.72, 340/635, 656, 654, 310.08, 3.1; 348/106, 348/754, 730, 830; 315/295, 149, 158; 713/1; 51/103

See application file for complete search history.

(56) References Cited

U.S. PATENT DOCUMENTS 3,859,755 A * 1/1975 Schaller ..... 451/5
5,355,162 A * 10/1994 Yazolino et al. ..... 725/116
5,724,106 A 3/1998 Autry et al.
5,811,942 A * 9/1998 Pedretti ..... 315/312
5,889,506 A 3/1999 Lopresti et al.
5,900,867 A 5/1999 Schindler et al.
5,995,155 A 11/1999 Shcindler et al.
6,037,721 A * 3/2000 Lansing et al. ..... 315/295
6,043,461 A 3/2000 Holling et al.
6,211,581 B1 4/2001 Farrant
6,377,685 B1 * 4/2002 Krishnan ..... 379/433.07
6,445,087 B1 * 9/2002 Wang et al. ..... 307/40
6,496,927 B1 * 12/2002 McGrane et al. ..... 713/1

* cited by examiner

*Primary Examiner*—Brian Zimmerman
*Assistant Examiner*—M Shimizu
(74) *Attorney, Agent, or Firm*—RatnerPrestia

(57) ABSTRACT

An exemplary method of providing positive power control of an electrical device which uses a toggle power command signal, and apparatus perform the method. This exemplary method uses an apparatus that includes a remote control unit and a signal translator. A positive power command signal is produced by and transmitted from the remote control unit. This positive power command signal is received by the signal translator. A present power condition of the electrical device is determined by the signal translator and compared to the positive power command signal. The toggle power command signal is then produced by and transmitted from the signal translator, if the positive power command signal and the present power condition of the electrical device do not match.

15 Claims, 10 Drawing Sheets

METHOD AND APPARATUS FOR POSITIVE CONTROL OF DEVICES WITH TOGGLE POWER CONTROL

FIELD OF THE INVENTION

This invention is in the field of remote control, and specifically relates to supplemental positive control of devices with toggle control.

BACKGROUND OF THE INVENTION

Due to remote control techniques often employed for audio-video appliances, a problem arises from controlling a single device using multiple controllers. For example, the power level of TV's and many audio appliances are controlled with a single command. This command toggles or changes the present power status (on/off) to the alternate power status (off/on). For this system to work consistently, the viewer must provide feedback by noting the present state of the electrical device before attempting remote control of the electrical device.

Also, with the convergence of personal computers and increasing complexity of audio-video appliances and systems, the ability to control VCR's, DVD's, home appliances, etc. by computer is becoming increasingly desirable. In many cases, standard remote control systems, with toggled power commands, mean that a computer cannot tell how a given command is going to affect the electrical device. For example, unless the initial on/off state of a VCR is known, the computer may not know whether an on/off toggle command signal turns the VCR on or off. Likewise, toggling the volume of a TV up one level sets the volume at a higher, but unknown level, or toggling the level of a fan to increase the intensity of the fan may have the opposite effect if the fan is already at its maximum level. Therefore, remote computer controlled devices may require user feedback for effective toggle power control.

SUMMARY OF THE INVENTION

One embodiment of the present invention is an exemplary method of providing positive power control of an electrical device which uses a toggle power command signal. This exemplary method uses an apparatus that includes a remote control unit and a signal translator. A positive power command signal is produced by and transmitted from the remote control unit. This positive power command signal is received by the signal translator. A present power condition of the electrical device is determined by the signal translator and compared to the positive power command signal. The toggle power command signal is then produced by and transmitted from the signal translator, if the positive power command signal and the present power condition of the electrical device do not match.

Another embodiment of the present invention is an exemplary remote positive power control apparatus for an electrical device which uses a toggle power command signal. The exemplary remote positive power control apparatus includes a remote control unit and a signal translator. The remote control unit has an input interface, a positive command signal generator, which is coupled to the input interface, and a positive command signal transmitter, coupled to the positive command signal generator. The positive command signal generator produces a positive power command signal, which is transmitted by the positive command signal transmitter. The signal translator includes a positive command signal receiver to receive the positive power command signal, an power condition sensor to detect an present power condition of the electrical device, logic means coupled to the positive command signal receiver and the power condition sensor, a toggle command signal generator, and a toggle command signal transmitter coupled to the toggle command signal generator. The logic means compares the positive power command signal and the present power condition of the electrical device to determine whether the toggle power command signal should be produced by the toggle command signal generator and transmitted from the toggle command signal transmitter to the electrical device.

Yet another embodiment of the present invention is an alternative exemplary remote positive power control apparatus for multiple electrical devices that use toggle power command signals and each electrical device uses a different corresponding toggle power command signal. The exemplary remote positive power control apparatus includes a remote control unit and a signal translator. The remote control unit has an input interface, a positive command signal generator, which is coupled to the input interface, and a positive command signal transmitter, coupled to the positive command signal generator. The positive command signal generator produces a positive power command signal, which is transmitted by the positive command signal transmitter. The signal translator includes a positive command signal receiver to receive the positive power command signal, an power condition sensor, logic means coupled to the positive command signal receiver and the power condition sensors, a toggle command signal generator coupled to the logic means, and a toggle command signal transmitter. The logic means compares the positive power command signal and the present power condition(s) of the electrical device(s) to which the positive power command signal corresponds to determine whether the toggle power command signal(s) should be produced by the toggle command signal generator and transmitted from the toggle command signal transmitter to the corresponding electrical device(s).

A further embodiment of the present invention is an alternative exemplary method of providing positive level control of an electrical device which uses a stepped level command signal. This exemplary method uses an apparatus that includes a remote control unit and a signal translator. A positive level command signal, which includes a user selected level, is produced by and transmitted from the remote control unit, based on user selection. This positive level command signal is received by the signal translator. A present power level of the electrical device is determined by the signal translator and compared to the user selected level of the positive level command signal. The number of stepped levels needed to change the present power level to the user selected level is determined. The stepped level command signal is produced by the signal translator and transmitted a number of times equal to the number of stepped levels determined to be needed to change the present power level to the user selected level.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION

The present invention involves a system and method to provide remote, positive on/off (and/or level) control for electrical devices which have toggled on/off (and/or level remote control. One advantage of this invention is that automated control of multiple devices may be simplified. It is noted that, although the following descriptions mostly focuses on the remote control of audio-visual systems, the disclosed designs and method may be practiced with any electric devices with remote control capabilities.

An exemplary solution to controlling power of electrical devices with toggled on/off control (i.e.-TV, VCR, ceiling fan . . .) is to monitor the current drawn by each device individually and send the power status of the electrical device back to the controlling processor. This device can also monitor current steps for variable power levels of an electrical device or devices (i.e.: ceiling fan). The present invention allows positive command (on, off, high, low, etc.) for power control of devices that only have a toggle power or change power command. Another method for power detection may be measurement of the "power on" indicator.

In this way, a user is able to remotely control the power status of any electronic device without the need for the user to see the electrical device and determine whether or not the electrical device needs the power status to be toggled or changed, or how many toggles are necessary. This may desirably allow automated equipment (timers, phone lines, and internet remotes) to control devices to a desired power status without a user providing feedback from the electrical devices (i.e. viewing the electrical device(s) and selecting the number of toggles needed) and may be useful where electronic equipment needs to "talk to" or control other electronic equipment. Using the present invention, a single function can power on a video cassette recorder (VCR) and a satellite television box (STB) to record an STB source program. Also, the present invention may be useful for remote programming of electrical devices that are not nearby or in an easily viewable place. Devices with multiple power setting or levels may be direct switched to a particular power setting without stepping through all the choices (i.e. -fan or light dimmer).

Figure 1A:
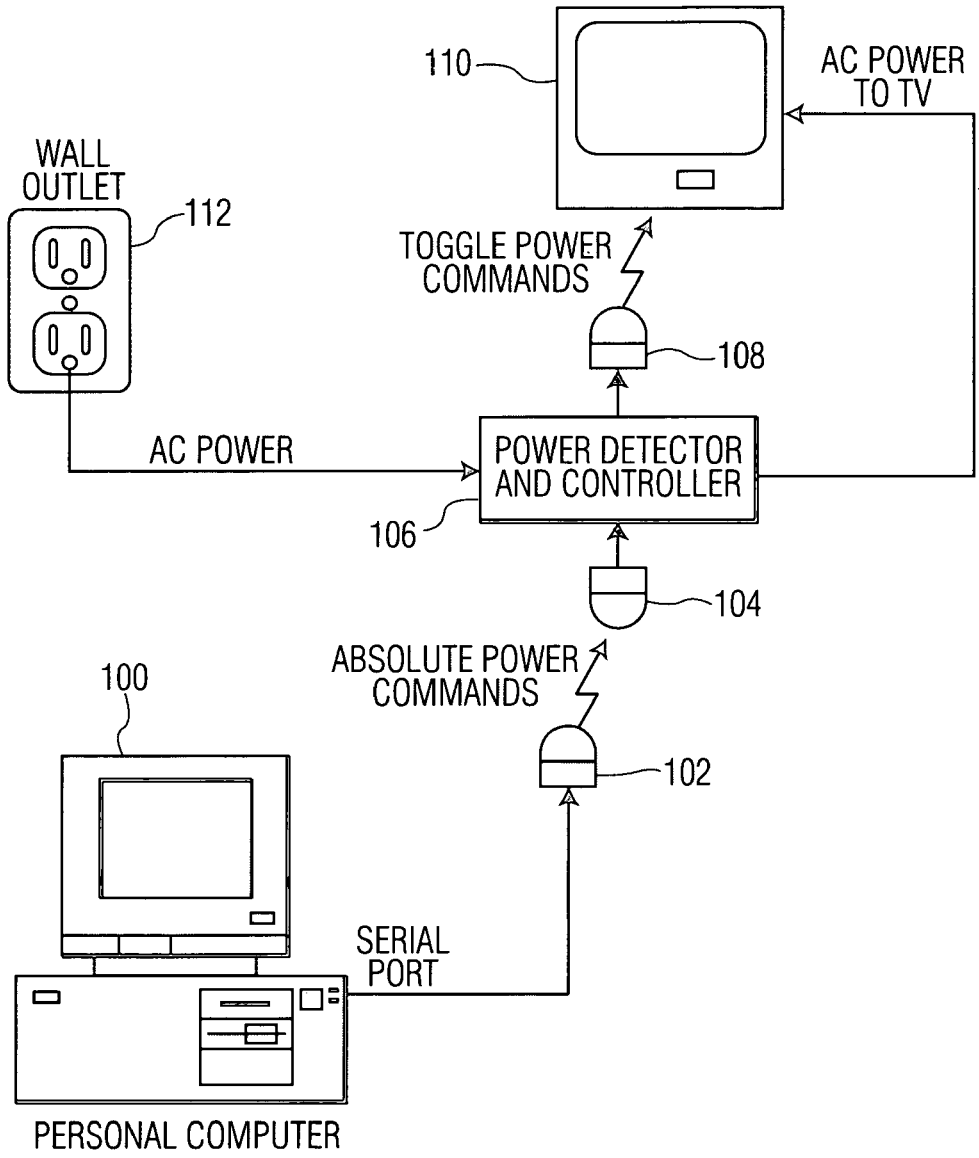
FIG. 1A is a block diagram illustrating an exemplary remote positive control system.

FIG. 1A shows a block diagram of an exemplary system where electrical device 110, shown as a TV, is controlled by a remote control unit that sends positive power commands (on, off, high, low, 1, 2, 3, etc.) for electrical device 110. The remote control unit includes an input interface (not shown), positive power command signal generator, in this example shown as personal computer 100, to produce the positive power command signals, and a positive signal transmitter 102, shown as an LED, for transmitting the positive command signal. Positive command signal receiver 104 receives a specific power command (on, off, high, low, 1, 2, 3, etc.) and relays it to signal translator 106. Signal translator 106 also monitors the AC power provided to electrical device 110 from wall outlet 112 to determine the present power status of the electrical device. When positive command signal receiver 104 gets a positive power command (such as on or off), signal translator 106 interprets the code to determine the proper power change code(s), if any, to be transmitted by toggle command signal transmitter, based on the code(s) and the current power status of the electrical device being controlled. When signal translator 106 determines that a power toggle command should be sent to the electrical device, a power toggle signal is generated, and then sent from toggle command signal transmitter 108, also shown as an LED.

Figure 1B:
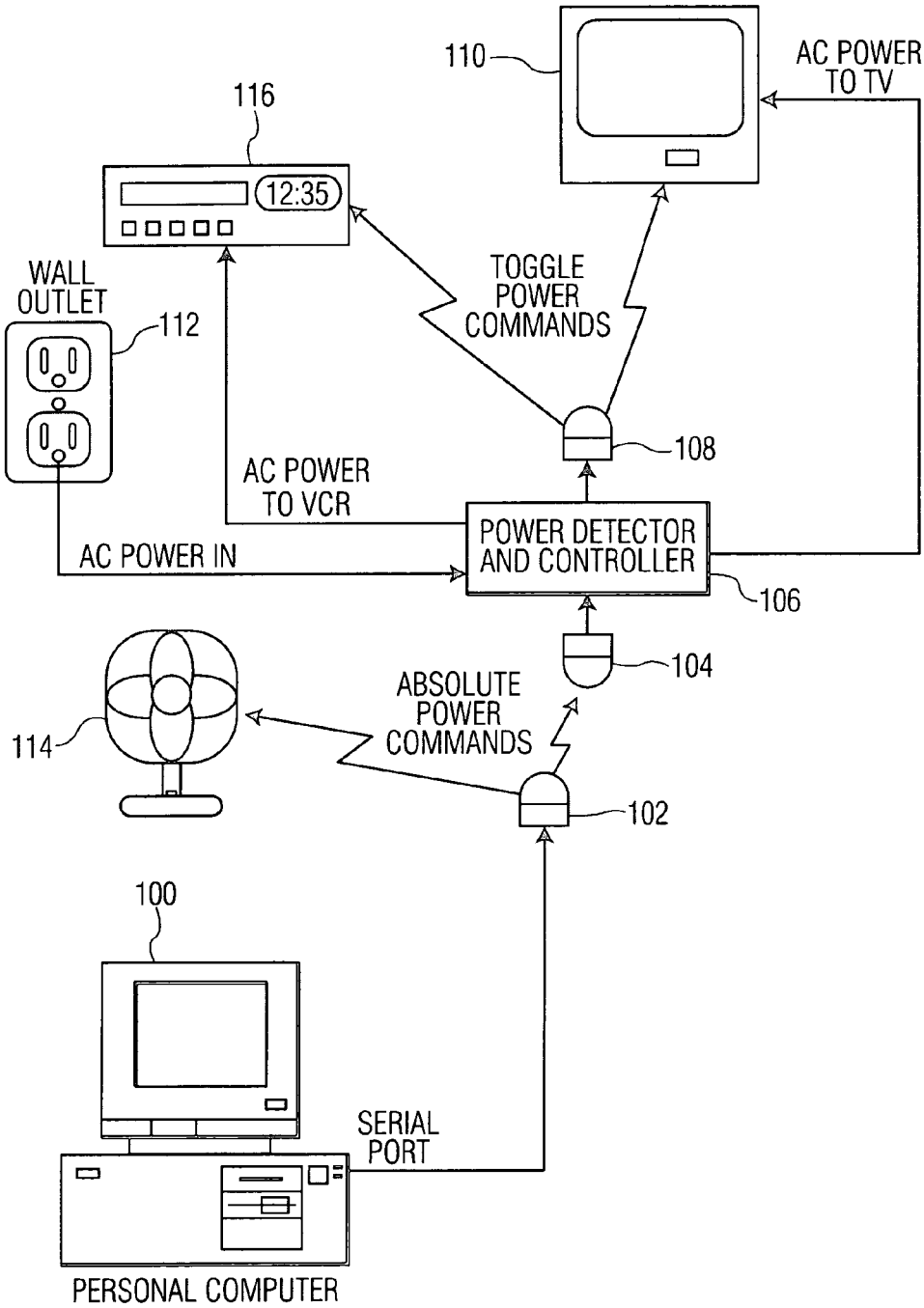
FIG. 1B is a block diagram illustrating an alternative exemplary remote positive control system, for multiple devices.

FIG. 1B shows a block diagram of an alternative exemplary system that may provide positive power control of several electrical devices, such as TV 110 and VCR 116 shown in the figure, which use toggle power command signals from a single remote control unit. The remote control unit may also control other electrical devices, such as fan 114, which use positive power command signals. The remote control unit includes an input interface (not shown), positive power command signal generator, in this example shown as personal computer 100, to produce the positive power command signals, and a positive signal transmitter 102, shown as an LED, for transmitting the positive command signal. The positive command signals may be transmit from positive power command transmitter 102 to signal translator 106 for the electrical devices that use toggle power command signals, TV 110 and VCR 116 in this example, and directly to the electrical devices that use positive power command signals, fan 114 in this example. Alternatively, initial positive power command signals for the electrical devices that use positive power command signals may be transmitted to signal translator 106, which may then transmit appropriate power command signals to all of the electrical devices being controlled from transmitter 108. Signal translator 106 desirably monitors the AC power provided to each of the electrical devices that use toggle power command signals from wall outlet 112. When positive command signal receiver 104 receives a positive power command (such as on or off) for one of the monitored electrical devices, signal translator 106 determines whether or not the power of the electrical device needs be toggled to match the state of the power command received. If signal translator 106 determines that a power toggle command should be sent to the electrical device, a power toggle signal is generated, and then sent from toggle command signal transmitter 108 (shown as an LED). Although the remote control unit is shown as using a computer 100, it is contemplated that other apparatus, such as a micro controller or a simple electronic circuit, may be used to generate the positive power command.

It is noted that the exemplary systems of FIGS. 1A and 1B may operate as a remote positive on/off control apparatus for at least one electrical device that uses a toggle on/off command signal or a remote positive level control apparatus for at least one electrical device that uses a stepped level command signal, or both. When operated as a remote positive on/off control apparatus, positive power command signal generator 100 of the remote control unit produces a positive on/off command signal. Also, the signal translator monitors the AC power provided to electrical device 110 (and/or electrical device 116) from wall outlet 112 to determine the current power condition of electrical device 110 (and/or electrical device 116). When operated as a remote positive level control apparatus, positive power command signal generator 100 of the remote control unit produces a positive level command signal. Also, the signal translator monitors the AC power provided to electrical device 110 (and/or electrical device 116) from wall outlet 112 to determine the present power level of electrical device 110 (and/or electrical device 116).

A number of methods may be used to indicate the desired power level for the electrical device being controlled. The input interface of the remote control unit may include a multi-position switch or a plurality of buttons to indicate the possible levels. For example, for positive on/off control of the electrical device a two position switch or two buttons (on and off) may be used as the input interface. Additional buttons and/or switches may allow for the selection of various electrical devices or combinations of electrical devices to be controlled by the power level selection. Alternatively, a touch screen, a computer mouse, (including joystick and track ball variations), a microphone, the keyboard of a personal computer, or even a telephone connected via a land-line or cellular connection may be used as the input interface.

Once the desired power commands are selected, they are processed by positive power command signal generator 100 to generate the appropriate positive power command signals. The positive power command signal generator may be special purpose positive command signal generation circuitry or it may be carried out within a general purpose computer system instructed to perform these functions by means of a computer-readable medium, as shown in FIGS. 1A and 1B. Such computer-readable media include; integrated circuits, magnetic and optical storage media, as well as audio-frequency, radio frequency, and optical carrier waves. It is noted that the special purpose positive command signal generation circuitry may also be able to be instructed by computer-readable media to allow additional programming flexibility.

The input commands may be configured to allow multiple devices to controlled by a single positive power command. For example, the command, DVD home theatre on, may be used to automatically provide positive power on control for a DVD player, TV, and surround-sound amplifier with a single command, no matter the previous on/off condition of the three electrical devices. Further, this command may be configured to provide positive power off control for other audio-video (AV) components, such as a VCR or STB, that may be connected to an exemplary home theatre system controlled by the present invention, but are unnecessary to the selected command.

Timing functions may also be incorporated to allow remote automation of electrical devices. For example, a remote controllable light with multiple toggled power levels may be controlled to positively switch between the power level at pre-selected times to simulate use as part of a home security system, without needing to set the light at a predetermined initial power level.

Positive command signal transmitter 102 of the remote control unit may include a number of different means for transmitting the selected positive command signal to the signal translator, and possibly to electrical devices that utilize positive command control, such as fan 114 in FIG. 1B. Possible types of transmission means that may be used include cables, such as coaxial cables, FireWire cables, USB cables, RS-232 cables, and optical fibers; optical transmitters; such as infrared or visible LED's and infrared lasers; and antennae, such as RF or microwave antennae. If positive command control electrical devices are to be controlled directly from the remote control unit, positive command signal transmitter 102 may include more than one type of transmitter to transmit the various command signals.

The selection of a transmission means also affects the selection of positive command signal receiver 104 of the signal translator. FIGS. 1A and 1B illustrate this receiver as a photodetector, but if an electrical cable is used as a transmission means, then the receiver instead includes a cable connector. Likewise, if an antenna is used as a transmission means, then the receiver may include an antenna.

Figure 2A:
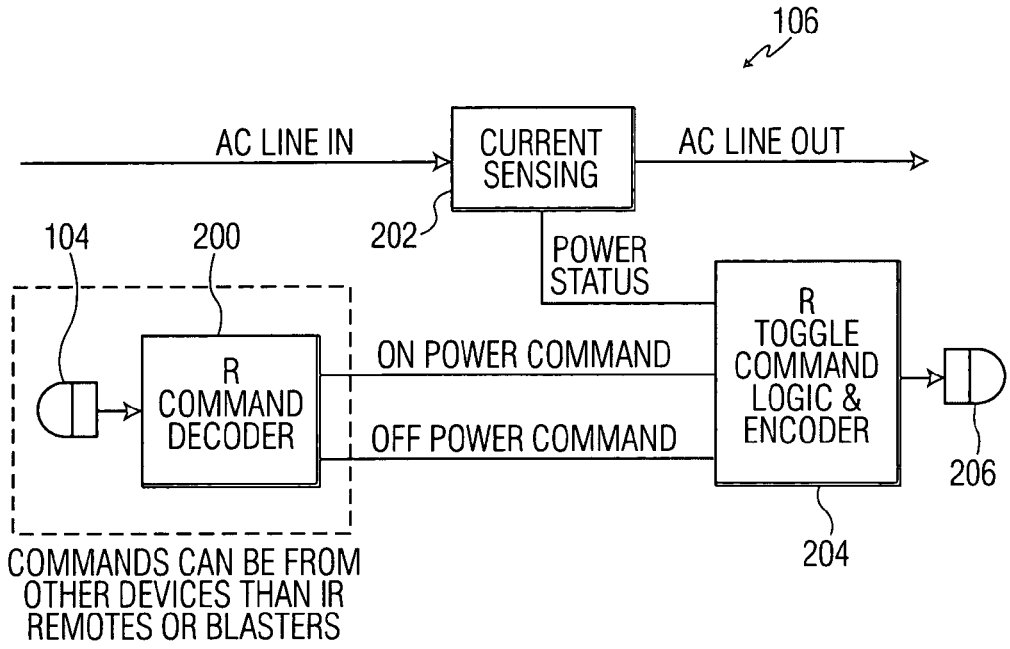
FIG. 2A is a block diagram illustrating an exemplary signal translator, which may be used in the exemplary systems of FIGS. 1A and 1B.
Figure 2B:
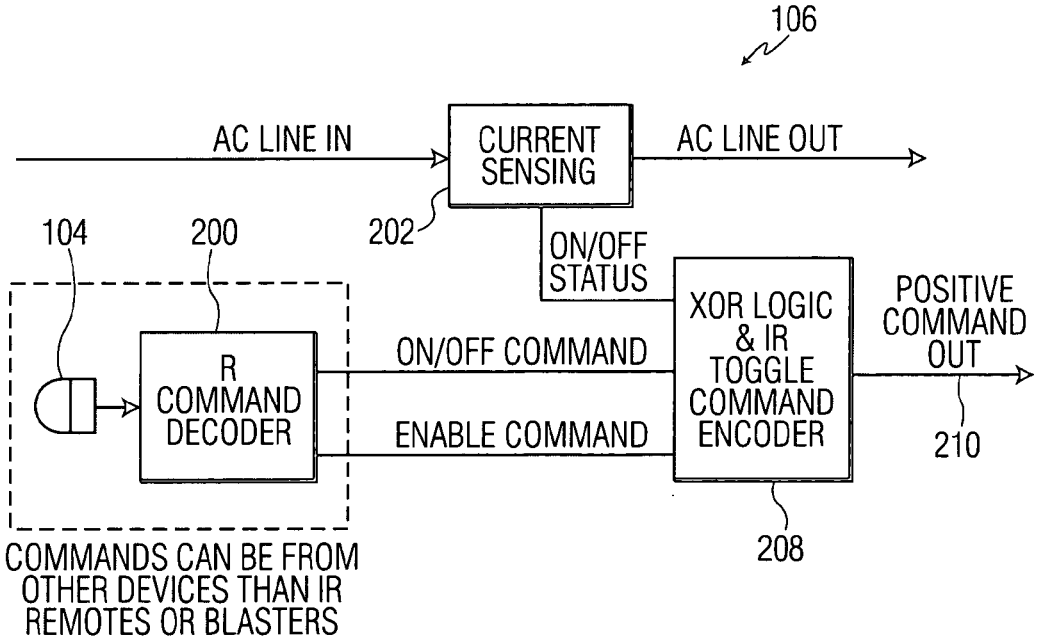
FIG. 2B is a block diagram illustrating an alternative exemplary signal translator, which may be used in the exemplary systems of FIGS. 1A and 1B.
Figure 2C:
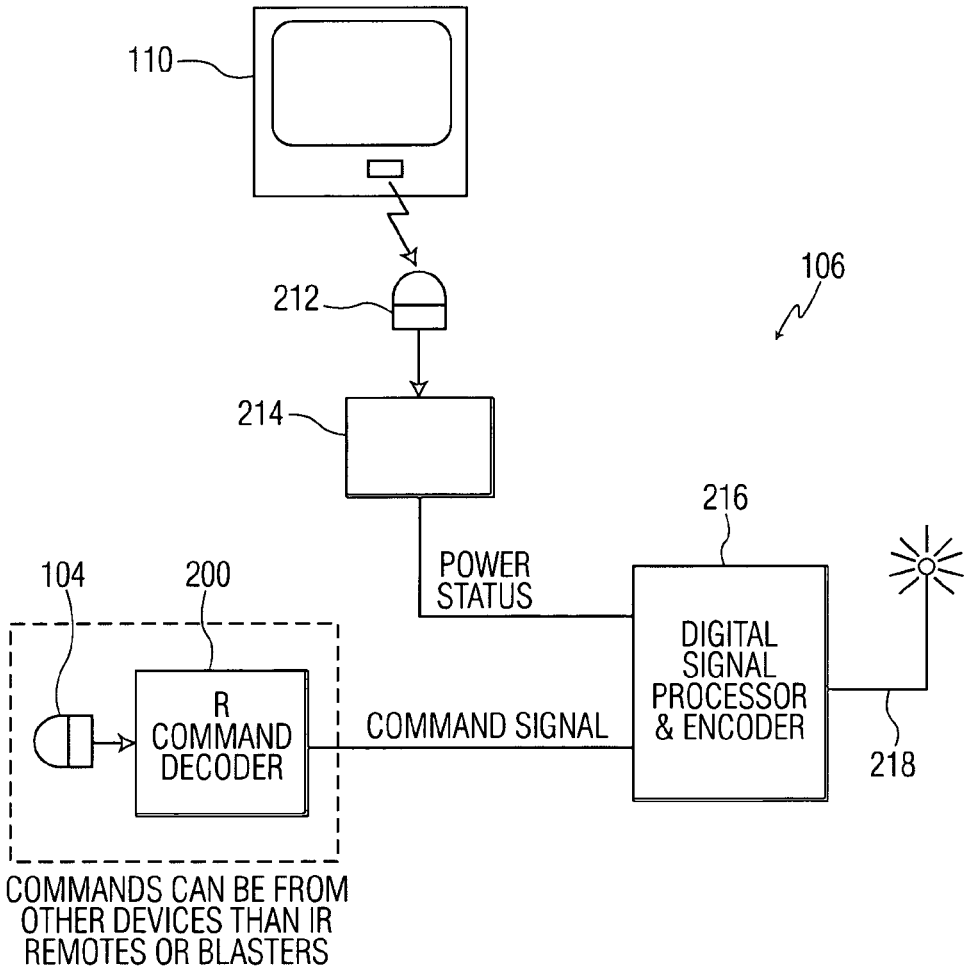
FIG. 2C is a block diagram illustrating an additional exemplary signal translator, which may be used in the exemplary systems of FIGS. 1A and 1B.

FIGS. 2A–C illustrate exemplary embodiments of signal translator 106, which include different possible features of that may be included within the present invention. The combinations of these features in these exemplary embodiments are meant to be illustrative. It is contemplated that other combinations of these features may be used to form further embodiments of signal translator 106. Signal translator 106 includes a power sensor to detect an on/off condition, or a present power level, of the electrical device. FIGS. 2A–C each illustrates power sensor 202 for systems with one electrical device. This choice is for ease of illustration.

Power sensor 202 in FIG. 2A senses the current drawn by an electrical device to determine a present power level of the device, which may include determining an on/off condition of the device. Exemplary current sensing power sensors are described in detail below with regard to FIGS. 3A–D. The present power level of the electrical device is relayed over a data channel to the logic means within logic and toggle command signal encoder 204. Desirably this data channel is an electrical connection, but other means, such as optical or radio-frequency transmission, may be used. The present power level of the device may be represented as a digital signal or an analog level. For example, an on/off condition may be relayed as a simple one bit binary signal (on=1, off=0).

In FIG. 2A, positive command signal receiver 104 is coupled to a positive signal decoder 200. This section decodes incoming command signals to determine the desired power level for the electrical device, and in the case of a system to control multiple devices, as shown in FIG. 1B, the desired electrical device. Positive signal decoder 200 also identifies false signals that should be disregarded, possibly due to other remote control devices or even reflected toggle command signals from signal translator 106 itself. Appropriate signals are then relayed to the logic means within logic and toggle command signal encoder 204. The exemplary embodiment in FIG. 2A may send a positive on command on one data channel and a positive off command on another data channel. These commands may be a simple one bit binary signal to indicate that the positive signal has been received. For systems designed to control multiple electrical devices, as shown in FIG. 1B, or for providing positive level control for devices with intermediate levels other than on and off, it may desirable for additional data channels to be included for the additional devices, and/or levels. The positive on, or off, command enables the logic means, which then determines whether to send a toggle command signal based on the power level determined by the current sensing power sensor 202.

The logic means of logic and toggle command signal encoder 204 may be special purpose circuitry or it may be software on a computer readable medium adapted to instruct a general purpose computer to determine whether to send a toggle command signal based on a truth table. The special purpose circuitry may also be designed to allow programming via computer readable media. In the exemplary embodiment shown in FIG. 2A the logic means includes two gates, using separate truth tables, one for a positive on command and one for a positive off command. The logic means may be enabled by the commands from command decoder 200 and the gates may have a single input, the on/off condition of the electrical device. In this exemplary embodiment, the positive on gate is a logical NOT and the positive off table is merely a buffer. Alternatively, the logic means may include a two-input gate for each positive command. In this case the positive off gate is a logical AND. A truth table for the positive on two-input gate is shown below in Table 1.

TABLE 1

| Positive on Command | On/off Condition | Toggle Signal |
|---|---|---|
| 0 | 0 | 0 |
| 0 | 1 | 1 |
| 1 | 0 | 1 |
| 1 | 1 | 0 |

When the logic means determines that a toggle on/off command signal should be sent, the toggle command signal generator of logic and toggle command signal encoder 204 encodes an appropriate toggle on/off command signal for the electrical device. In a system with multiple controlled electrical devices, each controlled device may have a separate logic means, but not necessarily a separate toggle command signal generator. The positive command signal generator may be special purpose circuitry or may software on a computer readable medium adapted to instruct a general purpose computer to generate toggle command signals responsive to the logic means. The special purpose circuitry may also be design to allow programming via computer readable media. This may be particularly desirable to allow programming of different codes for controlling different electrical devices.

Toggle command signal transmitter 206 is an optical transmitter, such as an infrared or visible LED or an infrared laser, and is electrically coupled to the toggle command signal generator of logic and toggle command signal encoder 204.

Turning to FIG. 2B, power sensor 202 senses the current drawn by an electrical device to determine an on/off condition of the device. The on/off condition of the electrical device is relayed over a data channel to the logic means within XOR logic and toggle command signal encoder 208. Desirably this data channel is an electrical connection, but other means, such as optical or radio-frequency transmission, may be used. The on/off condition of the device may be represented as a digital signal or an analog level. For example, a single on/off condition may be relayed as a simple one bit binary signal (on=1, off=0). The current sensing power sensors 202 shown in FIGS. 2A and 2B may be connected to more than one device to independently sense the current drawn by each device. The on/off condition, or a present power level, of each device may then be relayed to logic along the single data channel. Alternatively, a separate current sensor may be used for each electrical device and the present power levels of the devices relayed to the logic means by separate data channels.

Positive command signal receiver 104 is coupled to a positive signal decoder 200. As in the exemplary embodiment of FIG. 2A, this section decodes incoming command signals to determine the desired power level for the electrical device, and in the case of a system to control multiple devices, as shown in FIG. 1B, the desired electrical device. Appropriate signals are then relayed to the logic means within XOR logic and toggle command signal encoder 208. In the exemplary embodiment of FIG. 2B a positive on/off command is sent on one data channel and an enable command is sent on another data channel.

Whenever an enable signal is received by the logic means, the logic means determines the outcome of its truth table using the positive on/off command as one input signal and the on/off condition of the device determined by the current sensing power sensor as the other input signal. In this exemplary embodiment the logic means may desirably be a logical XOR (exclusive OR) gate.

When the logic means determines that a toggle on/off command signal should be sent, the toggle command signal generator of XOR logic and toggle command signal encoder 208 encodes an appropriate toggle on/off command signal for the electrical device. In a system with multiple controlled electrical devices, each controlled device may have a separate XOR gate, but not necessarily a separate toggle command signal generator. The toggle on/off command signal is then sent via toggle command signal transmitter 210. This transmitter is shown as a cable connecting to electrical device being controlled. Types of cables that may be used include coaxial cables, FireWire cables, USB cables, RS-232 cables, and fiber optic cables. Separate electrical devices may be connected using separate cables, possibly of different types.

FIG. 2C describes a method for determining power status using the power indicator light on the electrical device rather than the change in power line current. Often STB's and other electrical devices do not reduce power by turning them off. This method overcomes that problem. Photodetector 212 detects the indicator light, or lights, and power sensor 214 measures the power indicator light output to determine a power level of the electrical device. Power sensor 214 then sends a signal representing this level over a data channel to digital signal processor 216. It may be desirable for photodetector 212 to cover the indicator light to improve reliability. In such cases, an auxiliary light can be placed on the pickup to direct light to the user. Additionally, a number of photodetectors may be employed to monitor a number of indicator lights corresponding to different power levels.

As in the exemplary embodiments of FIGS. 2A and 2B, positive command signal receiver 104 is coupled to a positive signal decoder 200. This section decodes incoming command signals to determine the desired power level for the electrical device, and in the case of a system to control multiple devices, as shown in FIG. 1B, the desired electrical device. Appropriate signals are then relayed to digital signal processor 216 over a data channel. In the exemplary embodiment of FIG. 2C, more complicated digital signals may be transmitted to digital signal processor 216 data channel. This may be useful for systems designed to control multiple controlled electrical devices, as shown in FIG. 1B, or for providing positive level control for devices with intermediate levels other than on and off.

Digital signal processor 216 determines whether a toggle command signal needs to be sent based on the command signal from command signal decoder 200 and the power condition signal from power sensor 214 and may then encode appropriate toggle command signals based on this determination. In the case of positive on/off control, digital signal processor 216 may function as a logic gate and toggle command signal generator, or, in the case positive level control, digital signal processor 216 may function as comparison means to compare the present power level of the electrical device to the desired level selected by the user and a stepped level command signal generator.

The exemplary embodiment of FIG. 2C also illustrates toggle command signal transmitter 218 for transmitting the toggle command signal via an antenna, such as an RF antenna, or a microwave antenna. It is noted that multiple toggle command signal transmitters may be used for controlling multiple electrical devices. These multiple toggle command signal transmitters may be of any combination of the different types illustrated in FIGS. 2A–C.

When functioning as a comparison circuit, digital signal processor 216 may desirably determine the number of stepped level command signals necessary to change the present power level to the desired level. Alternatively, special purpose comparison circuitry or software on a computer readable medium may instruct a general purpose computer to compare the present power level and the selected level. The necessary number of stepped level command signals may be determined, or the comparison means may instead determine that a level change is necessary and direct the stepped level command signal generator to generate one stepped level command signal at a time until the levels match.

If the second, feedback, method of changing the power level of the electrical device is chosen, then comparison means may include, or function as, an analysis means to monitor stepping of the present power level of the electrical device. Once the level stepping begins the analysis means is enabled and, after each stepped level command signal is sent, the analysis means compares the new present power level of the electrical device to the desired level selected by the user. If the comparison means is functioning as the analysis means, it may be desirable for the analysis means to issue a command for the stepped level command signal generator to generate another stepped level command signal after each comparison that does not match. If the comparison means includes a separate analysis means, it may be desirable for the analysis means to do nothing until the present power level matches the desired level and then send an end stepping signal to the stepped level command signal generator. Meanwhile, the stepped level command signal generator continues to generate stepped level command signals one after another until the end-stepping signal is received.

A similar feedback system may also be used in a remote positive on/off control apparatus of the present invention designed to provide positive on/off control, to ensure that the toggle on/off command signal is properly transmitted and received. Following transmission of a toggle on/off command signal, the analysis means compares the new on/off condition of the electrical device to the desired on/off condition. If the two conditions do not match then the toggle on/off command signal may be sent again. Alternatively, the user may be notified by a feedback signal whether the electrical device has properly toggled. The feedback signal may be sent immediately, or only after a predetermined number of failures.

It is noted that the analysis means may be embodied as special purpose circuitry or as software on a computer readable medium adapted to instruct a general purpose computer to generate positive command signals responsive to the input interface.

Figure 3A:
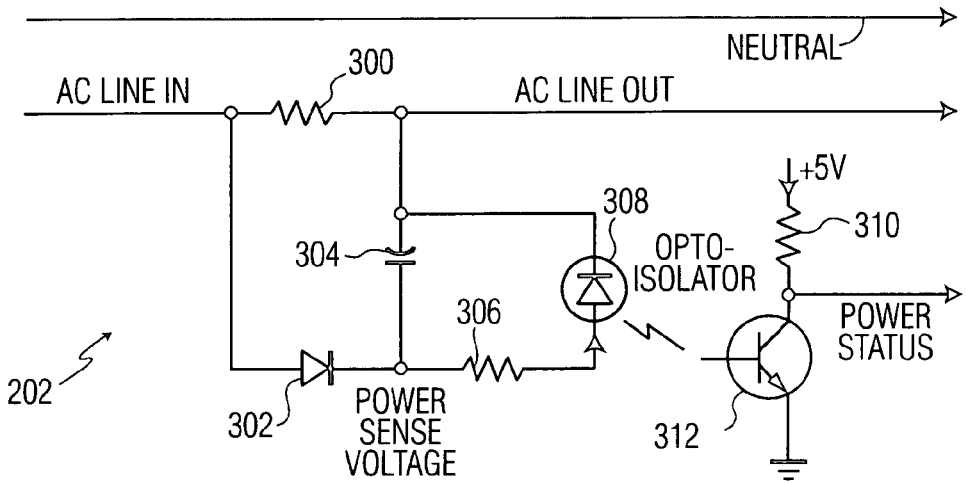
FIG. 3A is a schematic drawing of an exemplary level on/off condition sensor, which may be used in the exemplary signal translators of FIGS. 2A and 2B.

FIGS. 3A–D describe several exemplary embodiments of current sensing power sensor 202 for detecting the power status of a controlled electrical device. FIG. 3A uses an optical isolation method and load voltage drop across in-line resister 300 to measure the AC power level of the device. The exemplary circuit includes diode 302 and summing capacitor 304 to rectify and filter the signal. Opto-isolator LED 308 is coupled across summing capacitor 304 in series with protection resistor 306. Photo-transistor switch 312 is optically coupled to opto-isolator LED 308 to control the binary output signal from voltage source 310.

Figure 3B:
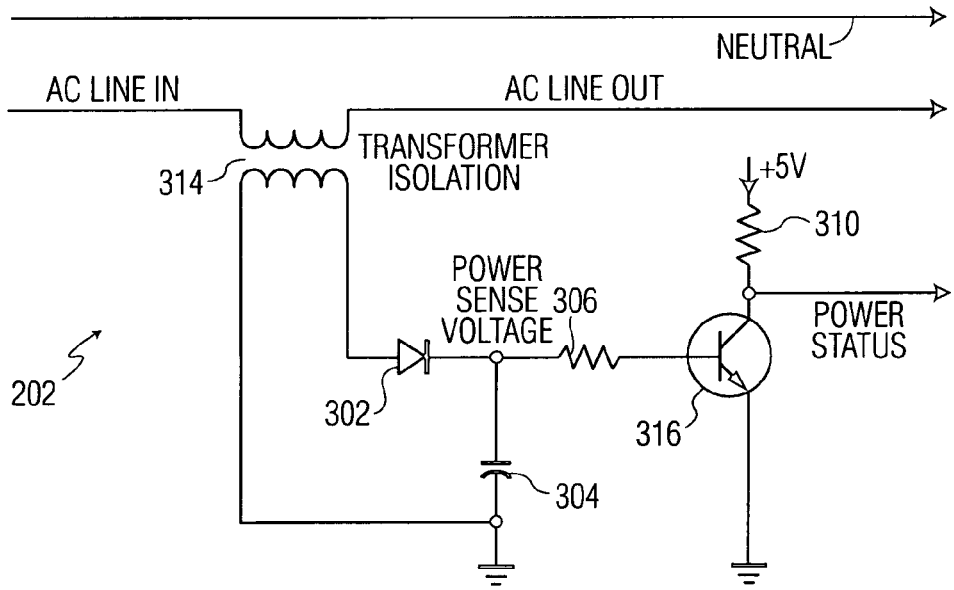
FIG. 3B is a schematic drawing of an alternative exemplary level on/off condition sensor, which may be used in the exemplary signal translators of FIGS. 2A and 2B.

FIG. 3B uses transformer 314 for isolation instead and measures current through the primary winding to generate an alternating voltage on the secondary leads. This voltage is again rectified using diode 302 and summing capacitor 304. The voltage across capacitor 304 is used to open and close transistor switch 316, thereby providing an on/off condition signal.

Figure 3C:
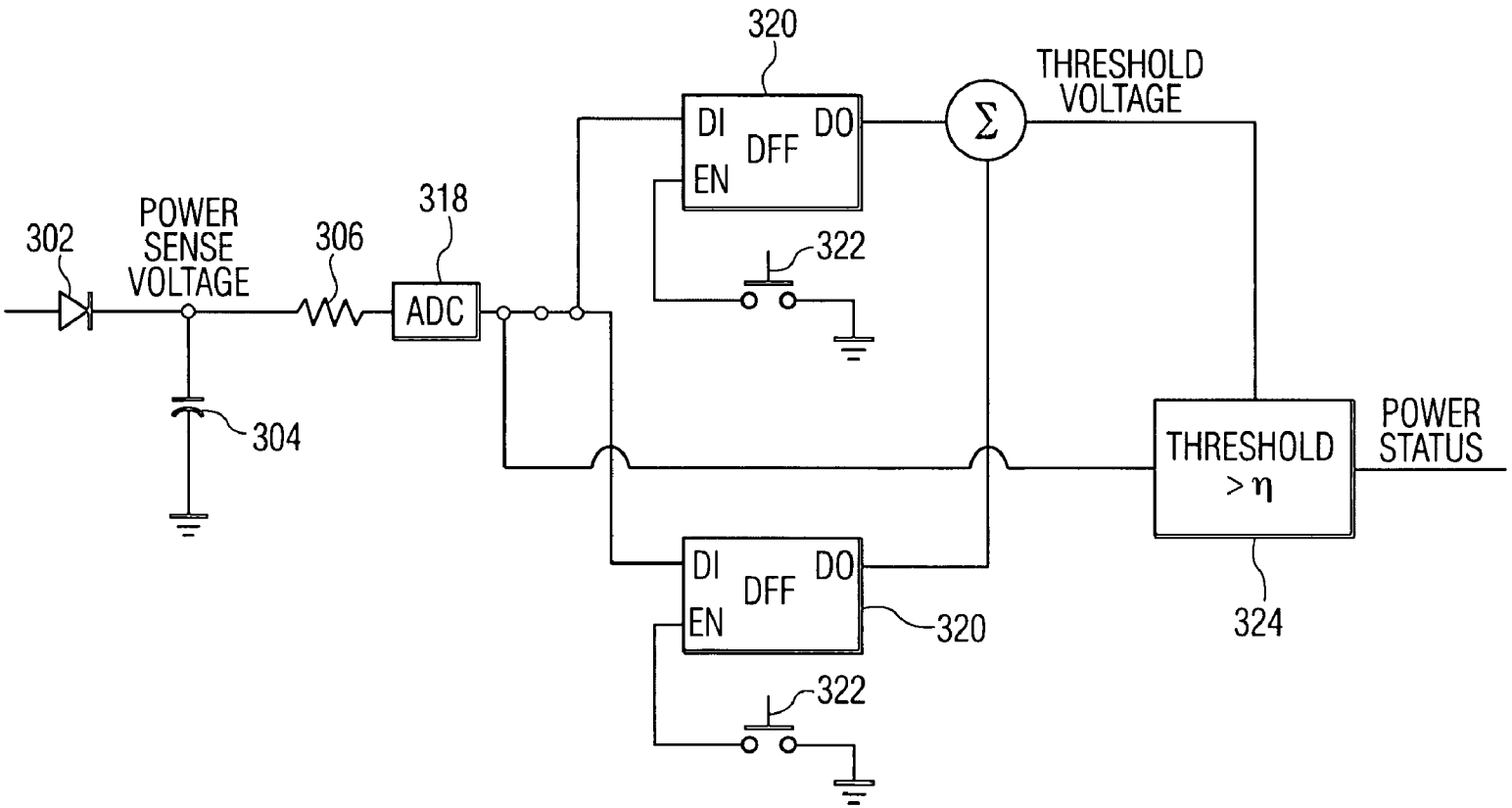
FIG. 3C is a schematic drawing of another exemplary level on/off condition sensor, which may be used in the exemplary signal translators of FIGS. 2A and 2B.

FIG. 3C describes a digital method of determining power level status. In this exemplary embodiment a DC voltage proportional to the AC power being drawn by the electrical device is again built up. This may be done, for example, using any of the apparatus described above or by using the current transformer described below. This analog voltage level is converted to a digital signal by analog to digital converter (ADC) 318. This signal is then compared to predetermined threshold levels in comparator 324 and a power level signal may then be sent the logic or comparison means described above with regard to FIG. 2A–C. These threshold levels may be stored in memory registers 320. Enabling switches 322 allow the levels to be set directly by enabling a memory register with the electrical device at a known level. The choice of two memory registers 320 and corresponding enabling switches 322 is only for illustrative purposes. More memory registers 320 and corresponding enabling switches 322 may be included to provide a larger range of threshold levels.

Figure 3D:
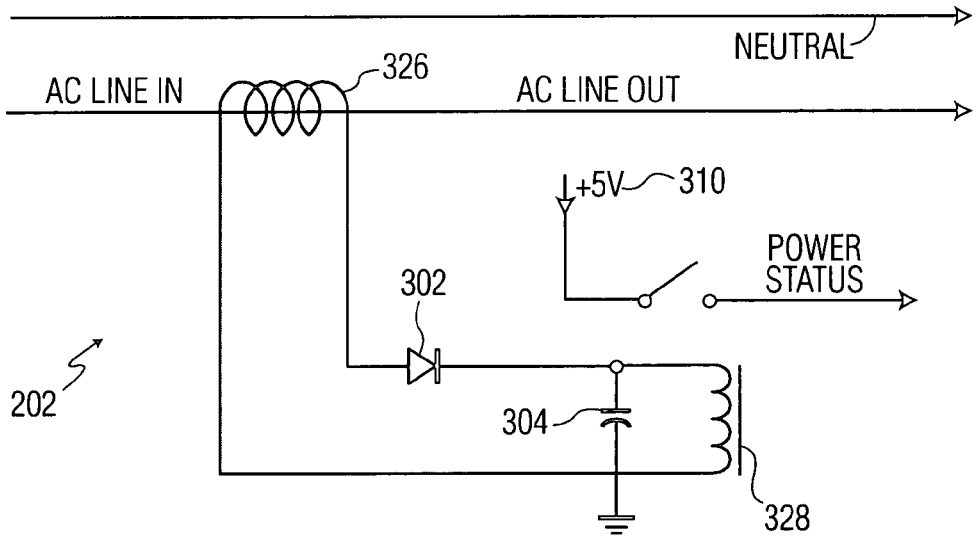
FIG. 3D is a schematic drawing of an additional exemplary level on/off condition sensor, which may be used in the exemplary signal translators of FIGS. 2A and 2B.

FIG. 3D illustrates an exemplary current sensing power sensor 202 using a current transformer 326, a wire forming several windings encircling the AC power cord of the electrical device, and relay switch 328. Relay switch 328 is coupled across summing capacitor similarly to switching transistor 316 in FIG. 3B to provide a binary on/off condition signal. One skilled in the art may appreciate that other power sensor configurations, such as combinations of the elements of the exemplary embodiments described above with regard to FIGS. 3A–D, may also be used for sensing the power level of the electrical device. Alternatively the sensor may be coupled to the neutral line.

Figure 4:
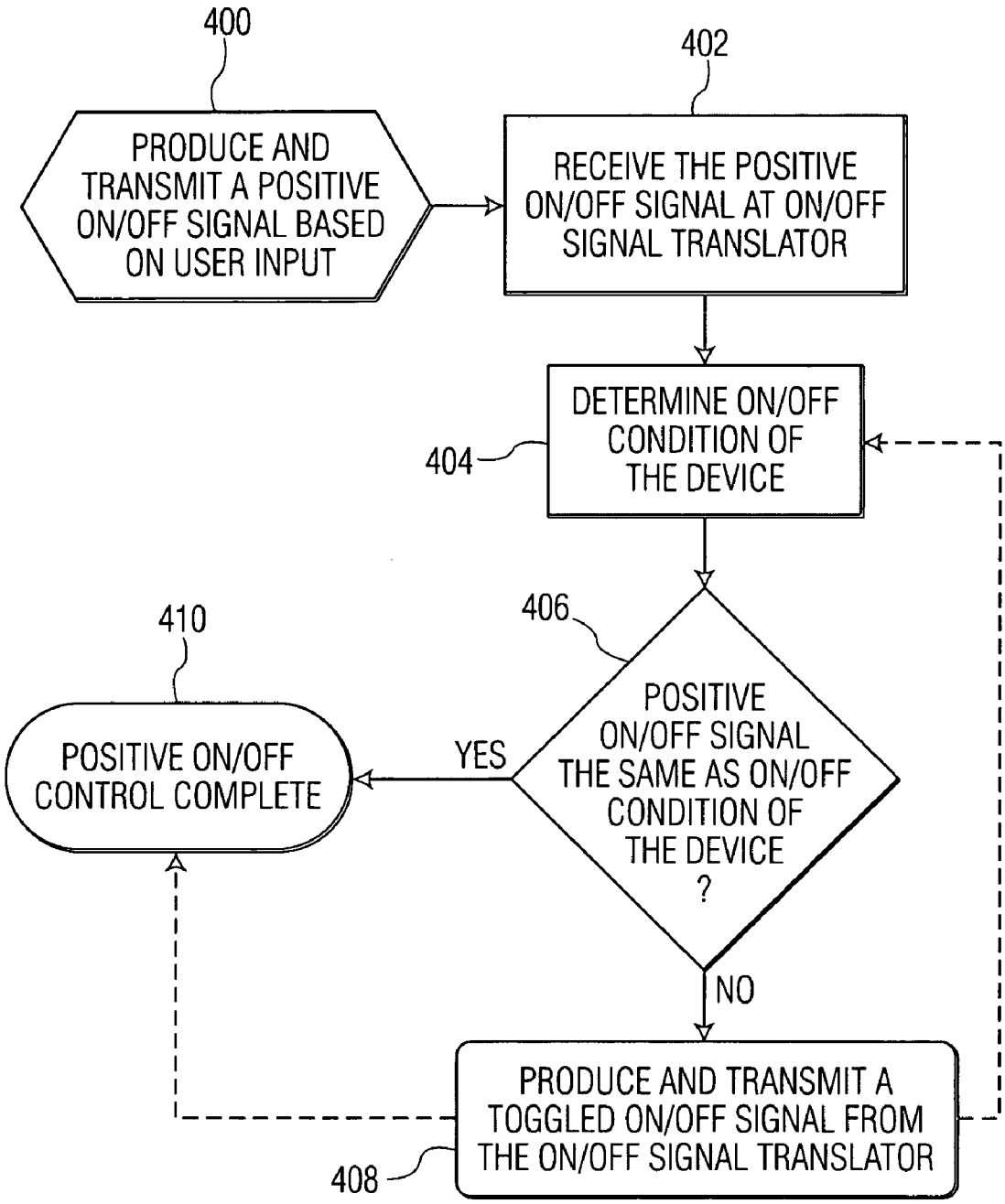
FIG. 4 is a flowchart illustrating an exemplary method of providing remote positive on/off control of devices having toggled on/off remote control.

FIG. 4 illustrates an exemplary method of providing positive on/off control of an electrical device that uses a toggle on/off command signal. This method may use an exemplary apparatus that includes a remote control unit and a signal translator, such as those described above with regard to FIGS. 1A and 1B. The method begins by producing and transmitting a positive on/off command signal from the remote control unit based on a user or controller input command, step 400. The input command may be for immediate control of the electrical device, or may be part of a programmed function to take place at a delayed time, such as turning off a TV after a predetermined time.

The positive on/off command signal is received by the signal translator, step 402, and the initial on/off condition of the electrical device is determined by an on/off condition sensor in the signal translator, step 404. The on/off condition sensor may continually monitor the on/off condition of the electrical device, or the on/off condition sensor may only be enabled when a positive on/off command signal is received by the signal translator.

The positive on/off command signal and initial on/off condition of the electrical device are compared to determine that the electrical device is already in the desire on/off state, step 406. If the positive on/off command signal and the initial on/off condition of the electrical device match, then the positive on/off control function is complete, step 410. If the positive on/off command signal and the initial on/off condition of the electrical device do not match, then a toggle on/off command signal is produced and transmitted from the signal translator, step 408.

The two dashed paths from step 408 indicate two alternative embodiments. The simpler embodiment is that the on/off state of the electrical device is assumed to have toggled in response to the toggle on/off command signal as intended and the positive on/off control function is assumed to be complete, step 410. In the second embodiment, the operation returns determine the new on/off condition of the electrical device, step 404, and again compare the determined on/off condition to the desired on/off condition, thereby ensuring that the on/off condition of the electrical device has been toggled as desired. A counting step to determine how many times the toggle on/off command signal has been transmitted may be added to this second embodiment to halt operation after a predetermined number of attempts. A feedback signal may also be sent to the user indicating that the toggle on/off command signal has failed to properly toggle the on/off condition of the electrical device.

Figure 5:
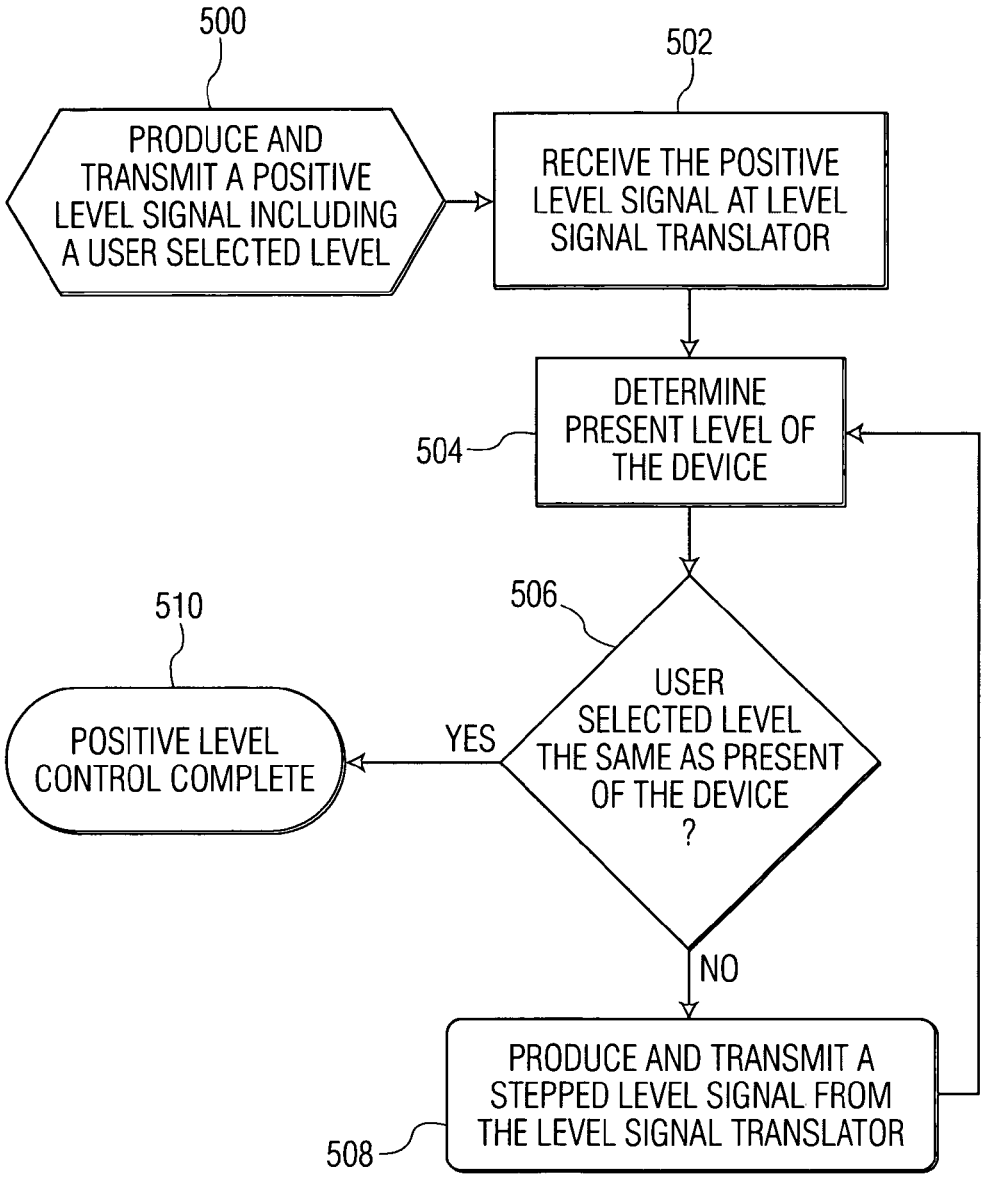
FIG. 5 is a flowchart illustrating an exemplary method of providing remote positive level control of devices having toggled level remote control.

FIG. 5 illustrates an exemplary method of providing positive level control of an electrical device that uses a toggle level command signal. This method may also use an exemplary apparatus that includes a remote control unit and a signal translator, such as those described above with regard to FIGS. 1A and 1B. The method begins by producing and transmitting a positive level command signal, which includes information of the user selected level, from the remote control unit based on user input, step 500. As in the exemplary method of FIG. 4, the user input may be for immediate control of the electrical device, or may be part of a programmed function to take place at a delayed time, such as turning off a TV after a predetermined time.

The positive level command signal is received by the signal translator, step 502, and the present power level of the electrical device is determined by a power level sensor in the signal translator, step 504. The power level sensor may continually monitor the present power level of the electrical device, or the power level sensor may only be enabled when a positive level command signal is received by the signal translator.

The user selected level of the positive level command signal and present power level of the electrical device are compared to determine the electrical device is already at the desired level, step 506. If the user selected level and the present power level of the electrical device match, then the positive level control function is complete, step 510.

If the user selected level and the present power level of the electrical device do not match, then a stepped level command signal is produced and transmitted from the signal translator, step 508. The operation then returns determine the new present power level of the electrical device, step 504. This present power level is compared to the desired on/off condition, step 506, and another stepped level command signal sent if they do not match, step 508. This loop continues until the present power level matches the desired level. A counting step may be added to determine if the loop has continued for an unreasonable number of times, which may indicate a problem. When the loop counter reaches a predetermined number, for example twice the number of levels, the operation may be halted. A feedback signal may also be sent to the user indicating that the positive level control function has failed to properly toggle the level of the electrical device.

Figure 6:
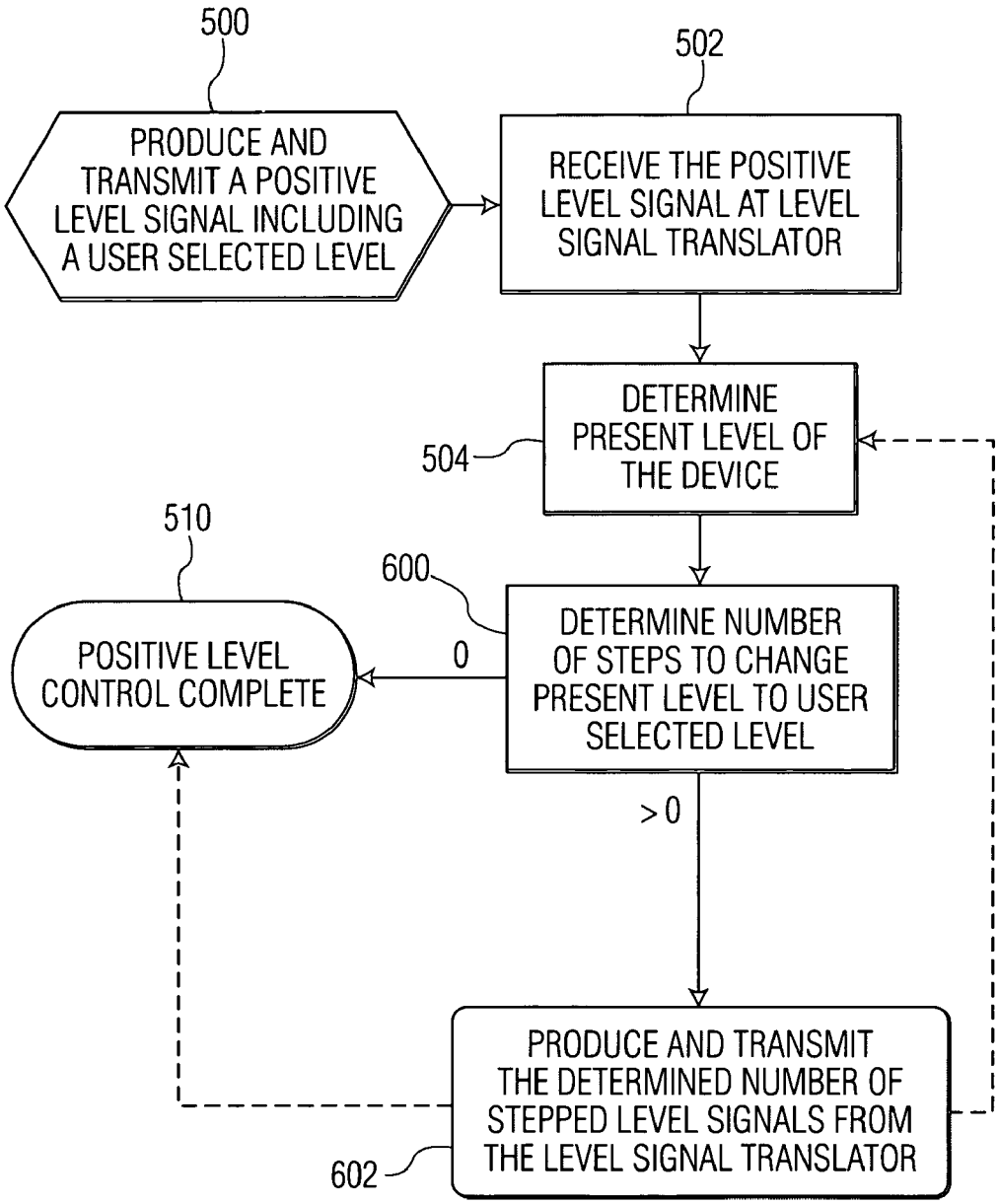
FIG. 6 is a flowchart illustrating an alternative exemplary method of providing remote positive level control of devices having toggled level remote control.

FIG. 6 illustrates an alternate exemplary method of providing positive level control of an electrical device that uses a toggle level command signal. This method may also use an exemplary apparatus that includes a remote control unit and a signal translator, such as those described above with regard to FIGS. 1A and 1B. The method begins by producing and transmitting a positive level command signal, which includes information of the user selected level, from the remote control unit based on user input, step 500. As in the exemplary methods of FIGS. 4 and 5, the user input may be for immediate control of the electrical device, or may be part of a programmed function to take place at a delayed time, such as turning off a TV after a predetermined time.

The positive level command signal is received by the signal translator, step 502, and the present power level of the electrical device is determined by a power level sensor in the signal translator, step 504. The power level sensor may continually monitor the present power level of the electrical device, or the power level sensor may be enabled only when a positive level command signal is received by the signal translator.

The user selected level of the positive level command signal and present power level of the electrical device are compared to determine the number of stepped levels necessary to toggle the level of the electrical device from the present power level to the desired, user selected level, step 600. If the user selected level and the present power level of the electrical device match (i.e. zero steps), then the positive level control function is complete, step 510. If one or more stepped levels are to be toggled so that the level of the electrical device matches the desired level, then that number of stepped level command signals are produced and transmitted from the signal translator, step 602.

The two dashed paths from step 602 indicate two alternative embodiments of this method. As in the method of FIG. 4, the simpler embodiment involves assuming that the level of the electrical device has toggled in response to the stepped level command signals as intended and, therefore, the positive level control function is complete, step 510. In the other embodiment, the operation returns to determine the present power level of the electrical device again, step 504, and compare the new present to the desired level, thereby ensuring that the level of the electrical device has been toggled as desired. A counting step to determine how many sets of stepped level command signals have been transmitted may be added to this second embodiment to halt operation after a predetermined number of attempts. A feedback signal may also be sent to the user indicating that the stepped level command signals have failed to properly toggle the level of the electrical device.

While the invention has been described with respect to particular embodiments, those of ordinary skill in the art will appreciate variations in these exemplary devices and methods that are within the scope of the attached claims.

What is claimed:

1. A remote positive power control apparatus for a plurality of electrical devices with a plurality of toggle power command signals, each electrical device using a corresponding toggle power command signal, the remote positive power control apparatus comprising:

a remote control unit including;

an input interface;

a positive command signal generator to produce a positive power command signal, the positive command signal generator coupled to the input interface; and a positive command signal transmitter, the positive command signal transmitter coupled to the positive command signal generator; and an signal translator including;

a positive command signal receiver to receive the positive power command signal;

a plurality of power condition sensors, each of the power condition sensors corresponding to one of the plurality of electrical devices to detect a present power condition of the corresponding device, each of the power condition sensors including means for generating a digital signal indicating presence of a current of a power signal providing operational power to the corresponding device;

logic means coupled to the positive command signal receiver and the plurality of power condition sensors to compare the positive power command signal and the corresponding present power condition of each electrical device;

a toggle command signal generator to produce the plurality of toggle power command signals; and a toggle command signal transmitter to transmit the plurality of toggle power command signals to the plurality of electrical devices, the toggle command signal transmitter coupled to the toggle command signal generator; and analysis means coupled to each of the plurality of power condition sensors and the toggle command signal generator to monitor toggling of the present power condition of each of the plurality of electrical devices, the analysis means being adapted to provide a feedback signal when the present power condition of the corresponding electrical device does not change in response to the toggle power command signal.

2. A method of providing positive level control of an electrical device which uses a stepped level command signal, using an apparatus including a positive level remote control unit and an signal translator, the method comprising the steps of:

a) producing and transmitting a positive level command signal from the positive level remote control unit, the positive level command signal being responsive to user selection and including a user selected level;

b) receiving the positive level command signal transmitted In step (a) at the signal translator;

c) determining a present power level of the electrical device;

d) comparing the user selected level of the positive level command signal received in step (b) and the present power level of the electrical device determined in step (c) and determining a number of stepped levels to change the present power level to the user selected level;

e) producing and transmitting the stepped level command signal from the signal translator according to the number of stepped levels determined in step (d).

3. A method of providing positive power control of an electrical device which uses a toggle power command signal, using an apparatus including a remote control unit and a signal translator, the method comprising the steps of:

a) producing and transmitting a positive power command signal from the remote control unit;

b) receiving the positive power command signal transmitted in step (a) at the signal translator;

c) determining a present power condition of the electrical device by generating a digital signal indicating presence of a current of a power signal providing operational power to the electrical device;

d) comparing the positive power command signal received in step (b) and the present power condition of the electrical device determined in step (c);

e) producing and transmitting the toggle power command signal from the signal translator, when the positive power command signal and the present power condition of the electrical device do not match; and f) generating a feedback signal when the present power condition of the electrical device does not change in response to the toggle power command signal.

4. The method of claim 3, step (f) further comprising the steps of:

f1) saving the present power condition prior to transmitting the toggle power command signal;

f2) determining a post-transmission power condition of the electrical device, after the toggle power command signal is transmitted;

f3) comparing the saved power condition of the electrical device and the post-transmission power condition of the electrical device determined in step (f1); and f4) re-transmitting the toggle power command signal from the signal translator and repeating steps (f1)–(f4), when the saved power condition and the post-transmission power condition of the electrical device compared in step (f3) match.

5. A remote positive power control apparatus for an electrical device which uses a toggle power command signal comprising:

a remote control unit including;

an input interface;

a positive command signal generator to produce a positive power command signal, the positive command signal generator coupled to the input interface; and a positive command signal transmitter, the positive command signal transmitter coupled to the positive command signal generator; and an signal translator including;

a positive command signal receiver to receive the positive power command signal;

a power condition sensor to detect a present power condition of the electrical device, the power condition sensor including means for generating a digital signal indicating presence of a current of a power signal providing operational power to the electrical device;

logic means coupled to the positive command signal receiver and the power condition sensor to compare the positive power command signal and the present power condition of the electrical device;

a toggle command signal generator to produce the toggle power command signal;

a toggle command signal transmitter, the toggle command signal transmitter coupled to the toggle command signal generator to transmit the toggle power command signal to the electrical; and analysis means coupled to the power condition sensor and the toggle command signal generator to monitor toggling of the present power condition of the electrical device, the analysis means being adapted to provide a feedback signal when the present power condition of the electrical device does not change in response to the toggle power command signal.

6. The remote positive power control apparatus of claim 5, wherein the power condition sensor of the signal translator includes a transformer coupled to a power cord of the electrical device.

7. The remote positive power control apparatus of claim 6, wherein the power condition sensor of the signal translator further includes:

a diode and a summing capacitor connected in series and coupled to the transformer; and at least one of;

a relay switch coupled to the summing capacitor;

an analog to digital converter coupled to the summing capacitor;

a transistor switch including a base, an emitter, and a collector, the base and the emitter coupled to the summing capacitor; and an opto-isolator LED coupled to the summing capacitor.

8. The remote positive power control apparatus of claim 6, wherein the transformer of the signal translator includes a wire forming a plurality of windings encircling a power cord of the electrical device.

9. The remote positive power control apparatus of claim 5, wherein the power condition sensor of the signal translator includes:

an in-line resistor coupled to a power cord of the electrical device;

a diode and a summing capacitor connected in series and coupled to the in-line resistor; and at least one of;

a relay switch coupled to the summing capacitor;

an analog to digital converter coupled to the summing capacitor;

a transistor switch including a base, an emitter, and a collector, the base and the emitter coupled to the summing capacitor; and an opto-isolator LED coupled to the summing capacitor and a photo-transistor switch optically coupled to the opto-isolator LED.

10. The remote positive power control apparatus of claim 5, wherein the power condition sensor of the signal translator includes a photodetector optically coupled to a power indicator light of the electrical device.

11. The remote positive power control apparatus of claim 5, wherein the logic means of the signal translator includes at least one of:

an exclusive OR (XOR.) gate configured to combine the present power condition and the positive power command signal in an XOR logic function;

a digital signal processor which compares the present power condition and the positive power command signal; and a general purpose computer and a computer readable medium adapted to instruct a general purpose computer to determine whether to generate a toggle power command signal based on the positive power command signal and the present power condition of the electrical device.

12. The remote positive power control apparatus of claim 5, wherein the toggle command signal generator reproduces the toggle power command signal in response to the feedback signal.

13. The remote positive power control apparatus of claim 5, wherein:

the remote positive power control apparatus further controls at least one positive power device which uses at least one true positive power command signal;

the power signal generator further produces the at least one true positive power command signal used by the at least one positive power device; and the positive command signal transmitter further transmits the at least one true positive power command signal.

14. The remote positive power control apparatus of claim 5, wherein the positive power command signal is one of a power on signal and a power off signal.

15. The remote positive power control apparatus of claim 5, wherein the positive power command signal is a power level signal.

* * * * *